US005261851A

United States Patent [19]

Siebert, Jr.

[11] Patent Number: 5,261,851

[45] Date of Patent: Nov. 16, 1993

[54] BALL SPINNER

[76] Inventor: Edward J. Siebert, Jr., 90 W. Main St., 3E, Meriden, Conn. 06450

[21] Appl. No.: 955,124

[22] Filed: Oct. 1, 1991

[51] Int. Cl.[5] ..... A63H 1/00; A63H 29/22

[52] U.S. Cl. ..... 446/236; 446/484

[58] Field of Search ..... 446/236, 242, 243, 246, 446/92, 144, 145, 177, 233, 234, 235, 484, 901

[56] References Cited

U.S. PATENT DOCUMENTS

| | | | |
|---|---|---|---|
| 1,985,716 | 12/1934 | Bueschel | 446/243 X |
| 2,846,809 | 8/1958 | Majewski | 446/92 |
| 3,054,217 | 9/1962 | D'Amato | 446/236 |
| 3,299,157 | 12/1966 | Schwartz et al. | 446/236 X |
| 3,423,872 | 1/1969 | Dodson . | |
| 3,509,659 | 5/1970 | Kau . | |
| 3,529,823 | 9/1970 | Garver | 446/901 X |
| 4,429,487 | 2/1984 | Taylor et al. . | |
| 4,571,204 | 2/1986 | Wang . | |
| 4,618,330 | 10/1986 | Abe . | |
| 4,637,152 | 1/1987 | Roy . | |
| 4,824,414 | 4/1989 | Goldblatt | 446/901 X |
| 4,891,031 | 1/1990 | Beaudry . | |
| 5,045,014 | 9/1991 | Harkins | 446/236 |
| 5,125,862 | 6/1992 | Paranto | 446/236 X |

FOREIGN PATENT DOCUMENTS

| | | | |
|---|---|---|---|
| 7900378 | 6/1979 | PCT Int'l Appl. | 446/901 |
| 1593 | of 1910 | United Kingdom | 446/236 |
| 758109 | 9/1956 | United Kingdom | 446/177 |

*Primary Examiner*—Robert A. Hafer
*Assistant Examiner*—Neal Muir
*Attorney, Agent, or Firm*—Weingarten, Schurgin, Gagnebin & Hayes

[57] ABSTRACT

A hand-held, motorized amusement device is provided for spinning a ball. A small battery powered motor, easily concealed in the palm of one hand, is attached to a shaft that extends upwardly from the hand and is concealed by one or more fingers. The end of the shaft supports a ball to be spun with the assistance of a small cup or by being inserted into the ball. When the motor is turned-on using a variable speed switch, the shaft and the ball spin, thereby creating the illusion of manually spinning the ball on a fingertip.

10 Claims, 4 Drawing Sheets

BALL SPINNER

FIELD OF THE INVENTION

This invention relates to an amusement device or toy, and more particularly to a hand-held, motorized device for spinning a ball.

BACKGROUND OF THE INVENTION

In the world of sports, the ability to spin a ball, such as a basketball, volleyball or football, on the tip of one finger never ceases to amaze spectators. As anyone who has ever attempted the feat will attest, it is extremely difficult to spin a ball like Curly Neal of the Harlem Globetrotters for more than an instant. However, with a lot of practice, a great deal of coordination, and a bit of luck, one can learn how to spin a ball on one finger for a considerable time period. Many people, however, would love to be able to perform the trick flawlessly sans dedication and skill.

For those who would be satisfied with creating the illusion of spinning a ball, some form of mechanical or motorized aid could provide the desired control. Unfortunately such a device presently does not exist.

SUMMARY OF THE INVENTION

For surmounting the difficulties of manually spinning a ball, an amusement device is provided having a switch activated battery powered motor, connected to a shaft adapted for supporting a ball. The shaft is rotatably actuated by the motor, causing the ball supported thereon to spin. The device may further include an adaptor cup on the end of the shaft to stabilize the ball. Further stability may be provided with a hook and pile fastener. The shaft may be either of a fixed length or telescopic and either permanently attached to or removable from the motor.

BRIEF DESCRIPTION OF THE DRAWINGS

These and further features of the invention may be better understood with reference to the accompanying specification and the drawings in which.

DETAILED DESCRIPTION OF THE INVENTION

Figure 1:
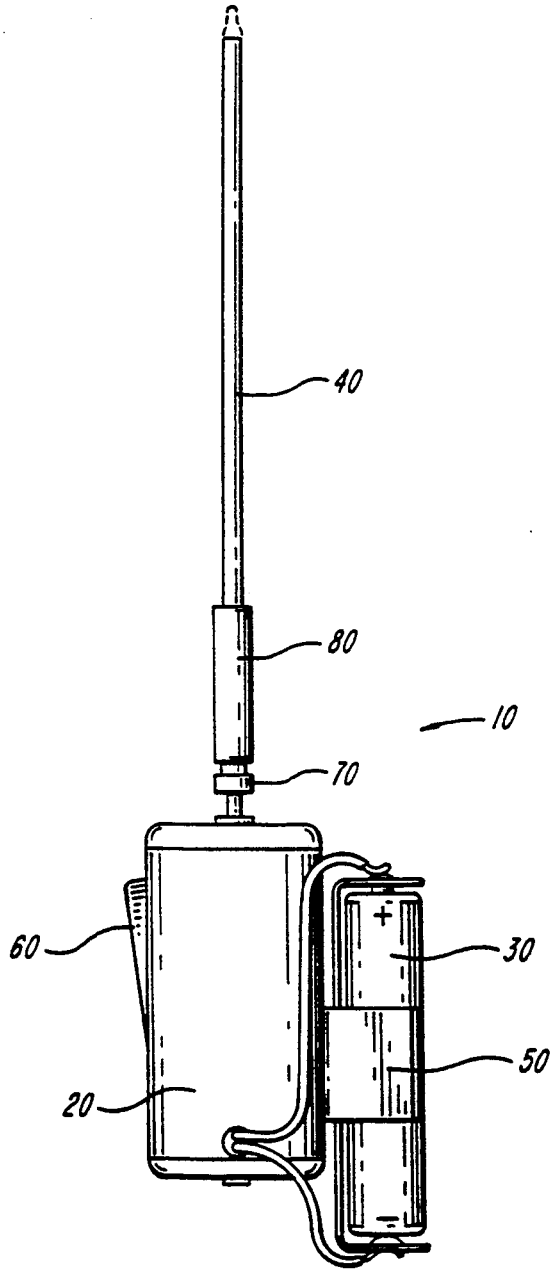
FIG. 1 is a side view of a ball spinner.

Referring to FIG. 1, a ball spinner 10 is shown comprising a motor 20, a power supply 30, and a ball shaft 40. The motor 20 is a simple and inexpensive direct current motor, and the power supply 30 is a single battery, such as an "AA" cell mounted in a bracket 50 attached to the motor 20. A switch 60 controls the flow of energy from the power supply 30 to the motor 20 and may be either a simple on/off switch or a variable speed control switch. In this illustrative embodiment, a motor shaft 70 protrudes from one end of the motor 20 and is connected to a socket 80 to which the ball shaft 40 is removably attached. Alternatively, the ball shaft 40 may be permanently affixed to the motor 20. The ball shaft 40 can be of a fixed length or it can be telescopic and generally has a maximum length of about six inches. Various lengths and diameters of ball shafts 40 can be provided to be concealable by various sizes of fingers of users. When the switch 60 is activated, the motor 20 imparts forces to the ball shaft 40 causing the shaft 40 to be rotatably actuated and causing a ball disposed at the end of the ball shaft 40 to spin.

Figure 2:
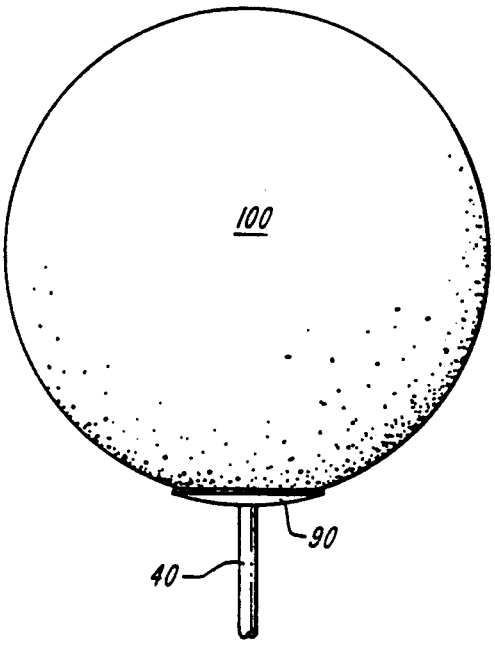
FIG. 2 is side view of a ball adaptor cup useful with round balls.

While a ball can be balanced on the tip of the ball shaft 40 when it is spinning, it is difficult to balance the ball for a sustained period of time. Therefore, as depicted in FIG. 2, an adaptor cup 90 for retaining a round ball 100 on the tip of the ball shaft 40 is shown. The adaptor cup 90 is mounted on the end of the ball shaft 40 and can be used with many types of balls of differing sizes. The adaptor cup 90 is preferably fabricated from a flexible material, such as silicone rubber, to permit the adaptor cup 90 to conform to the shape of the ball 100 placed thereon.

Figure 3:
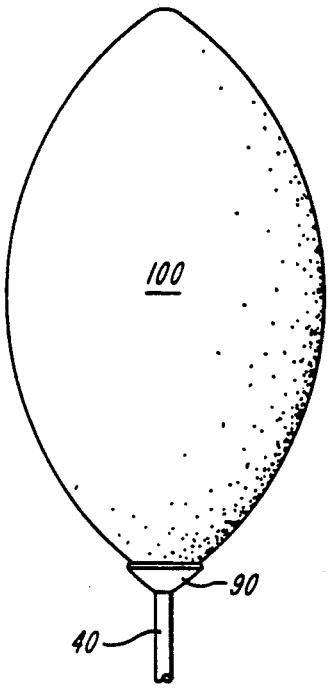
FIG. 3 is a side view of an alternative adaptor cup useful with oblong balls.
Figure 4:
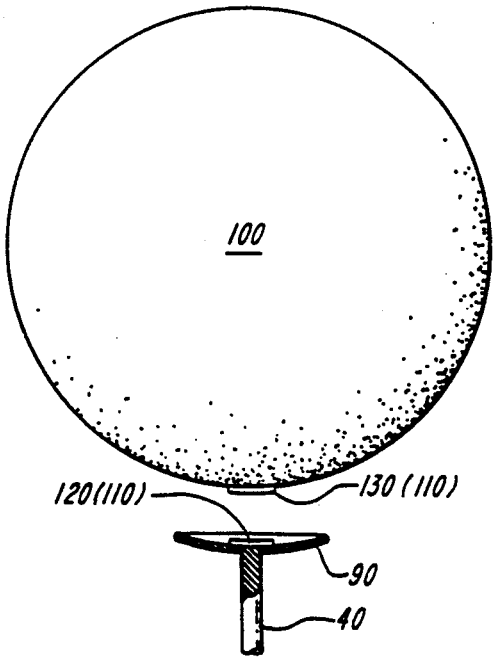
FIG. 4 is a side view of an adaptor cup incorporating a hook and pile attachment device.

FIG. 3 depicts an adaptor cup 90 used with an oblong ball 100, such as a football. The adaptor cup 90 can also be equipped with a supplemental ball retention device 110, such as a hook and pile fastener, e.g. velcro, as shown in FIG. 4. A swatch of fabric with hooks 120 is adhered to the bottom of the adaptor cup 90 and a swatch with the pile 130 is stuck to the ball 100. Thus, when the ball 100 is placed into the adaptor cup 90 with the hook and pile fastener aligned, the ball is secured therein. An advantage of using the adaptor cup 90 is that a great variety of available balls may be used with the ball spinner 10.

Figure 5:
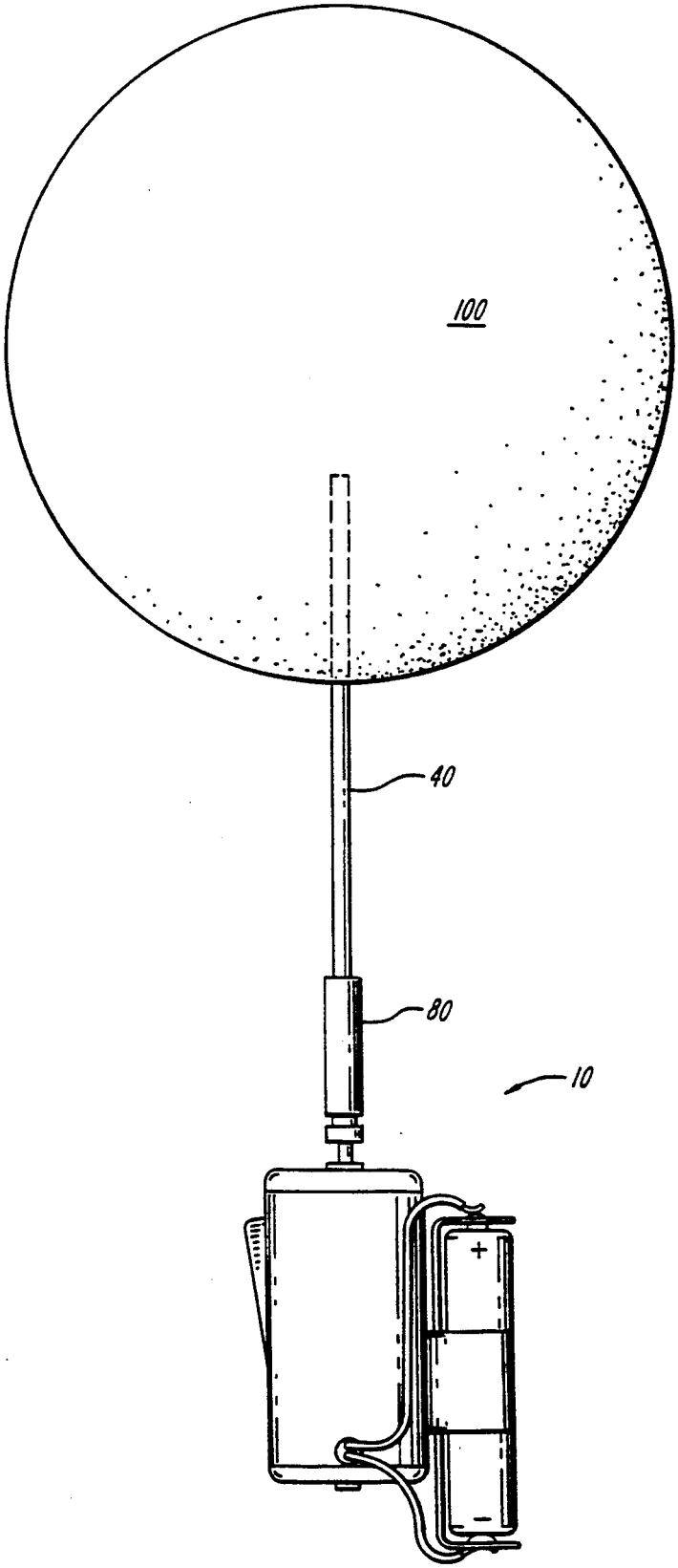
FIG. 5 is a perspective view of the ball spinner of FIG. 1, which depicts an alternate method of securing a ball to the ball spinner.

Referring to FIG. 5, an alternative method of securing the shaft to the ball shaft 40 is shown. By removing the adaptor cup 90 from the shaft 40, the shaft 40 may be inserted into the interior of a ball configured to matably receive the ball shaft 40. This technique works especially well with any non-inflatable ball, such as a rigid plastic or a foam ball 100, and has several advantages over the spinning technique using an adaptor cup 90. One advantage of the embedded shaft 40 is that the operator has complete assurance that the ball 100 will not disengage from the ball spinner 10. Another advantage is that when the telescopic shaft 40 is properly adjusted, the existence of the ball spinner 10 is more readily camouflaged. The ball spinner 10 may be sold in a set which includes a variety of balls 100 mountable on detachable ball shafts 40. The operator selects a ball 100 to be spun, inserts the shaft 40 into the socket 80, and he is ready to start having fun. Alternatively, an intrusive "needle-type" shaft can be provided, which can be poked into non-inflatable plastic or foam balls.

Figure 6:
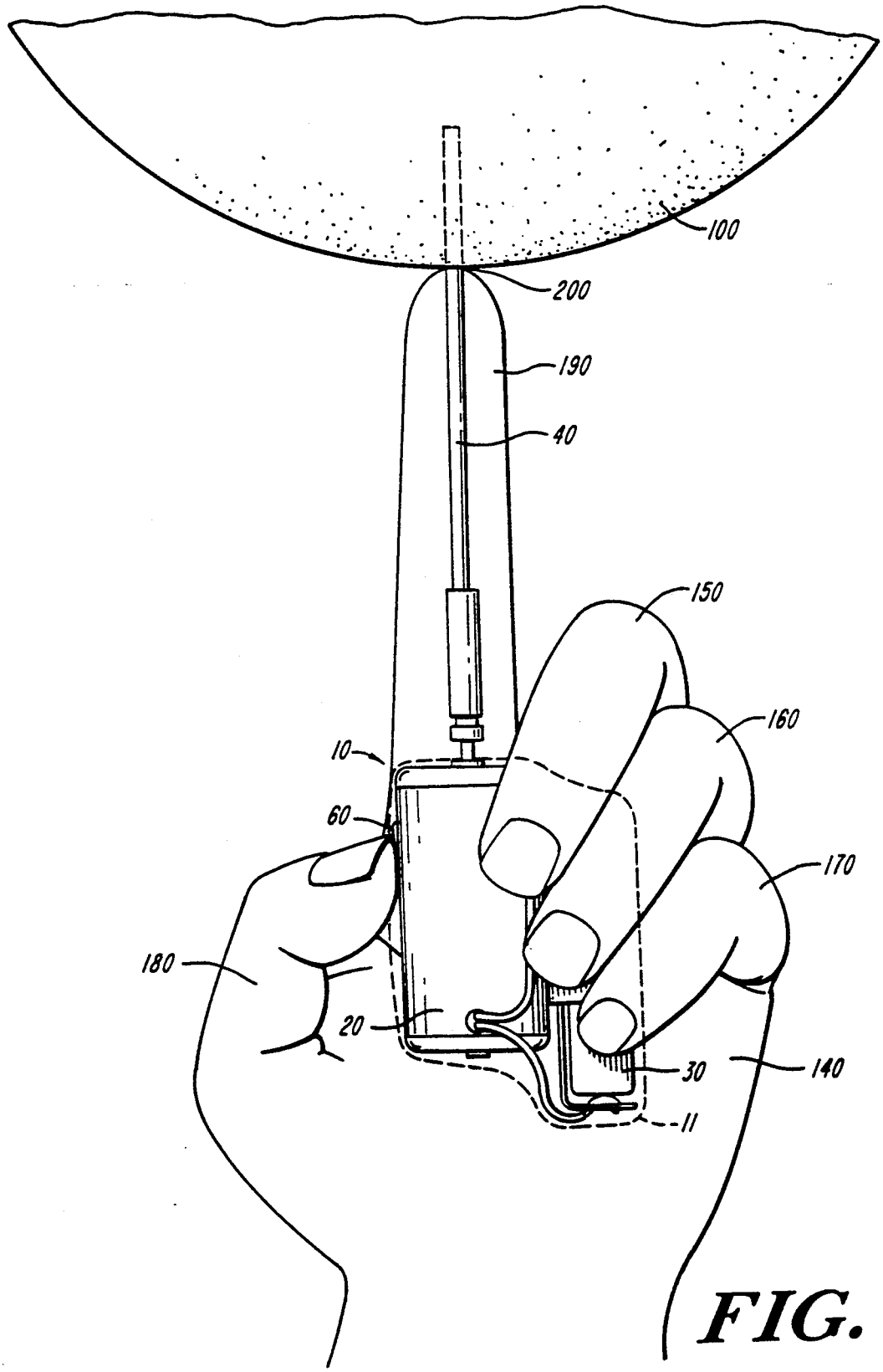
FIG. 6 is a perspective view of the ball spinner of FIG. 1 positioned in an operator's hand.

Referring to FIG. 6, the ball spinner is shown correctly positioned for use in an operator's hand 140. The motor 20 and power supply 30 together are sufficiently small to be comfortably placed and concealed in the palm of a user's hand 140. The motor 20 is held in position by the middle finger 150, ring finger 160 and pinky 170. The thumb 180 is used both to grasp the ball spinner 10 and to activate the switch 60. Proper positioning and use of the index finger 190 is critical. A flesh colored formed or molded housing 11 can be provided for the motor and power source and can be form fitted to ensure proper positioning in the hand. After grasping the ball spinner 10, the index finger 190 is extended upward from the hand 140, parallel and adjacent to the shaft 40, so that the tip 200 of the index finger almost or just barely touches the surface of the ball 100 or the bottom of the adaptor cup 90 (not shown). The operator then orients his hand 140 so that the index finger 190 conceals the ball shaft 40 and prevents spectators from seeing the shaft 40. When the switch 60 is activated, the ball 100 spins and the spectators gasp!

The ball spinner 10 may also be used to spin other objects such as an egg or a figure skating doll. For evening use, a translucent plastic ball 100 incorporating a light source may be used with the ball spinner 10. A glow in the dark material can be used.

Although the ball shaft is described herein as being generally about six (6) inches in length, one of ordinary skill in the art will appreciate that the ball shaft can be various variable lengths, and various diameters, so as to accommodate various sizes of fingers behind which the ball shaft is concealed during operation.

While the ball spinner power supply is described herein as a "AA" cell mounted in a bracket attached to the motor, it will be appreciated that various other power sources can be implemented in practicing the invention, including without limitation, other cell sizes and mounting means or winding spring mechanisms as commonly used in other toys and novelty items.

Although a silicone rubber adapter cup is described wherein a hook fastener is disposed for supplemental ball retention, it will be appreciated that the pile portion of the hook and pile fastener can be placed in the cup with the hook portion disposed on the ball, and that other retention schemes can be devised such as tacky adhesives, magnets or the like.

Although the ball spinner is described herein having a switch that is activated by a user's thumb, it will be appreciated that alternative switching means and locations can be provided such as various compression switches which are activated by pressure of the user's hand.

Although the invention has been shown and described with respect to exemplary embodiments thereof, various other changes, omissions and additions in form and detail thereof may be made therein without departing from the spirit and scope of the invention.

What is claimed is:

1. A hand-held, amusement device spinning a ball and simulating a said ball spinning on a finger of a person comprising:

a hand-held motor substantially concealable within a hand of said person, said hand-held motor being enclosed in a housing conformable to said hand of said person;

a power source in communication with said hand-held motor;

a switch for regulating power to said hand-held motor; and an adjustable length elongated ball shaft having a first end and a second end, said elongated ball shaft engaged and supported by said hand-held motor at said first end and said elongated ball shaft having a supporting means adapted to release said ball and supporting said ball at said second end, said elongated ball shaft extending substantially parallel and adjacent to an extended finger so that said supporting means supporting said ball is proximate to the tip of said extended finger when said hand-held amusement device is operated wherein said hand-held motor causes said ball shaft to rotate which causes said ball to spin and simulate said ball spinning on said finger of said person.

2. The device of claim 1, wherein said supporting means is an adaptor cup secured to said second end of said elongated ball shaft for stabilizing said ball on said elongated ball shaft.

3. The device of claim 2, wherein said adaptor cup further includes a portion of a hook and pile fastener.

4. The device of claim 1, wherein said elongated ball shaft is a fixed length.

5. The device of claim 1, wherein said elongated ball shaft is telescopic.

6. The device of claim 1, further comprising a socket attached to a motor shaft for detachably connecting said elongated ball shaft to said motor shaft.

7. A hand-held, amusement device spinning a ball and simulating a ball spinning on a finger tip of a person comprising:

a hand-held motor;

a battery in electrical communication with said hand-held motor;

a switch for regulating current flow between said battery and said hand-held motor;

an adjustable length shaft having a first end and a second end, said shaft connected to said hand-held motor at said first end; and an adaptor cup secured to said second end of said shaft for stabilizing said ball on said shaft, said adaptor cup releasably engaging said ball, said shaft extending substantially parallel and adjacent to said fingertip when simulating said ball spinning on said fingertip so that said adaptor cup is proximate thereto;

wherein said shaft and said adaptor cup secured thereto are rotatably actuated by said hand-held motor causing said ball to spin.

8. The device of claim 7 wherein at least the motor and power source are housed in a form fitted housing.

9. The device of claim 8, wherein said shaft comprises a ball permanently affixed thereto.

10. A method of spinning a ball comprising:

a grasping a ball spinning in one hand, said ball spinner comprising:

a motor;

a power source in communication with said motor;

a switch for regulating power imparted to said motor; and a shaft having a first end and a second end, said shaft connected to said motor at said first end and adapted for supporting said ball at said second end;

concealing said motor and said power source in said one hand;

extending a finger outward from said hand;

adjusting said shaft so that said shaft extends parallel and adjacent to said finger and said second end is proximate the tip of said finger;

orienting said hand so that said power source, said motor, said switch and said shaft are not visible to a spectator;

affixing said ball on said second end of said shaft; and activating said switch to cause said shaft and said ball placed thereon to spin.

* * * * *

UNITED STATES PATENT AND TRADEMARK OFFICE

CERTIFICATE OF CORRECTION

PATENT NO. : 5,261,851

DATED : November 16, 1993

INVENTOR(S) : Edward J. Siebert, Jr.

It is certified that error appears in the above-indentified patent and that said Letters Patent is hereby corrected as shown below:

Column 3, line 46, "simulating a said" should read --simulating said--.

Column 4, line 44, "a grasping" should read --grasping--.

Signed and Sealed this

Sixteenth Day of August, 1994

Bruce Lehman

*Attest:*

BRUCE LEHMAN

*Attesting Officer*

*Commissioner of Patents and Trademarks*